United States Patent [19]

McCabe

[11] Patent Number: 4,943,198

[45] Date of Patent: Jul. 24, 1990

[54] APPARATUS FOR SEPARATING LAUNDRY ARTICLES

[75] Inventor: Stanley G. McCabe, Lubbock, Tex.

[73] Assignee: Jensen Corporation, Fort Lauderdale, Fla.

[21] Appl. No.: 403,301

[22] Filed: Sep. 5, 1989

[51] Int. Cl.[5] ..... B65G 47/12

[52] U.S. Cl. ..... 414/13; 198/434; 198/443; 198/445; 198/447; 198/468.2; 198/803.7; 414/392; 414/734; 209/937

[58] Field of Search ..... 198/434, 443, 445–447, 198/468.2, 470.1, 803.7, 953; 414/13, 392, 729, 734, 917; 212/255, 262, 259; 209/937; 38/7, 8

[56] References Cited

U.S. PATENT DOCUMENTS

| | | | |
|---|---|---|---|
| 890,159 | 6/1908 | Miller et al. | 414/392 |
| 1,808,406 | 6/1931 | Gammell . | |
| 2,998,136 | 8/1961 | Gerisch | 209/122 |
| 3,092,263 | 6/1963 | Beaudry et al. | 414/13 |
| 3,696,942 | 10/1972 | Kitchener et al. | 414/13 |
| 4,036,365 | 7/1977 | Rosenfeld | 209/73 |
| 4,136,778 | 1/1979 | Wortman et al. | 209/589 |
| 4,239,435 | 12/1980 | Weiss et al. | 414/136 |
| 4,396,108 | 8/1983 | Sticht | 198/953 |
| 4,740,134 | 4/1988 | Dixon | 198/468.2 |

FOREIGN PATENT DOCUMENTS

| | | | |
|---|---|---|---|
| 231586 | 4/1925 | United Kingdom | 198/803.7 |

*Primary Examiner*—Joseph E. Valenza
*Attorney, Agent, or Firm*—Oltman and Flynn

[57] ABSTRACT

This apparatus for separating wet laundry articles (e.g., bed sheets) has an air cylinder-operated entry clamp which picks up a pile of such articles outside the entry end of the apparatus and lifts them into the apparatus, an entry conveyor which helps move the laundry articles into the apparatus, a lower conveyor which receives the laundry articles after they are dropped by the entry clamp and carries them toward the opposite end of the apparatus, a curved baffle plate against which the laundry articles on the lower conveyor pile up at the opposite end, an air cylinder-operated separator clamp which moves up-and-down and back-and-forth substantially along the centerline of the lower conveyor and picks up the laundry articles piled against the baffle plate and then drops them onto the lower conveyor, removal clamps which move up past the opposite side edges of the baffle plate and pick up individual laundry articles and carry them up and back toward the entry end of the apparatus, an exit conveyor running horizontally cross-wise above the lower conveyor for receiving the laundry articles after they are dropped by the removal clamps, and a motor-driven roller next to the exit conveyor for depositing the lower parts of these articles onto the exit conveyor.

38 Claims, 12 Drawing Sheets

APPARATUS FOR SEPARATING LAUNDRY ARTICLES

SUMMARY OF THE INVENTION

This invention relates to separating wet laundry articles, such as bed sheets, from a tangled pile of such articles.

One of the arduous, potentially injurious chores in institutional laundries, such as in hospitals or hotels, is to separate wet, laundered bed sheets for ironing and folding. Typically, the sheets come from the washing machines in a tangled pile which makes it difficult and heavy work to separate them. A laundry worker must be careful not to injure himself or herself, particularly his or her back, when performing this onerous task.

A principal object of this invention is to provide a novel power-operated apparatus for separating laundry articles in a tangled pile, particularly wet sheets.

Further objects of this invention will be apparent from the following detailed description of a presently-preferred embodiment, shown in the accompanying drawings.

Preferably, the presently apparatus has a lower horizontal conveyor running from the entry end of the apparatus to an opposite end. An entry clamp on a chain is moved by air cylinders and pistons from a raised, retracted position inside the entry end of the apparatus to an extended, lowered position in front of the entry end, where it is actuated to grasp a pile of wet laundry articles. The chain then raises the entry clamp and retracts it just behind the entry end, where it drops the pile of laundry articles onto the lower conveyor. As the entry clamp carries the pile of laundry articles into the apparatus, their lower, trailing ends are engaged and carried up by an endless belt entry conveyor before the entry clamp drops them onto the lower conveyor. The laundry articles on the lower conveyor pile up against a curved baffle plate at its opposite end. Here, a separator clamp picks up the laundry articles, usually several at a time, and carries them back toward the entry end of the apparatus before dropping them onto the lower conveyor, where they pile up against the baffle plate but are now largely separated from one another. The separator clamp is on a chain operated jointly by a vertical air cylinder, for raising and lowering this clamp, and a horizontal air cylinder, for moving this clamp toward and away from the baffle plate. A pair of chains move up past the opposite side edges of the baffle plate, carrying the clamps which are actuated to pick up the laundry articles, usually one at a time, and carry them back toward the entry end of the apparatus and then drop them onto an exit conveyor. The exit conveyor is a substantial distance above the lower conveyor and runs transversely of it. Just before reaching the exit conveyor, the lower, trailing ends of the individual laundry articles engage a motor-driven roller which assists in depositing them on the exit conveyor.

Before explaining the disclosed embodiment of the present ivention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
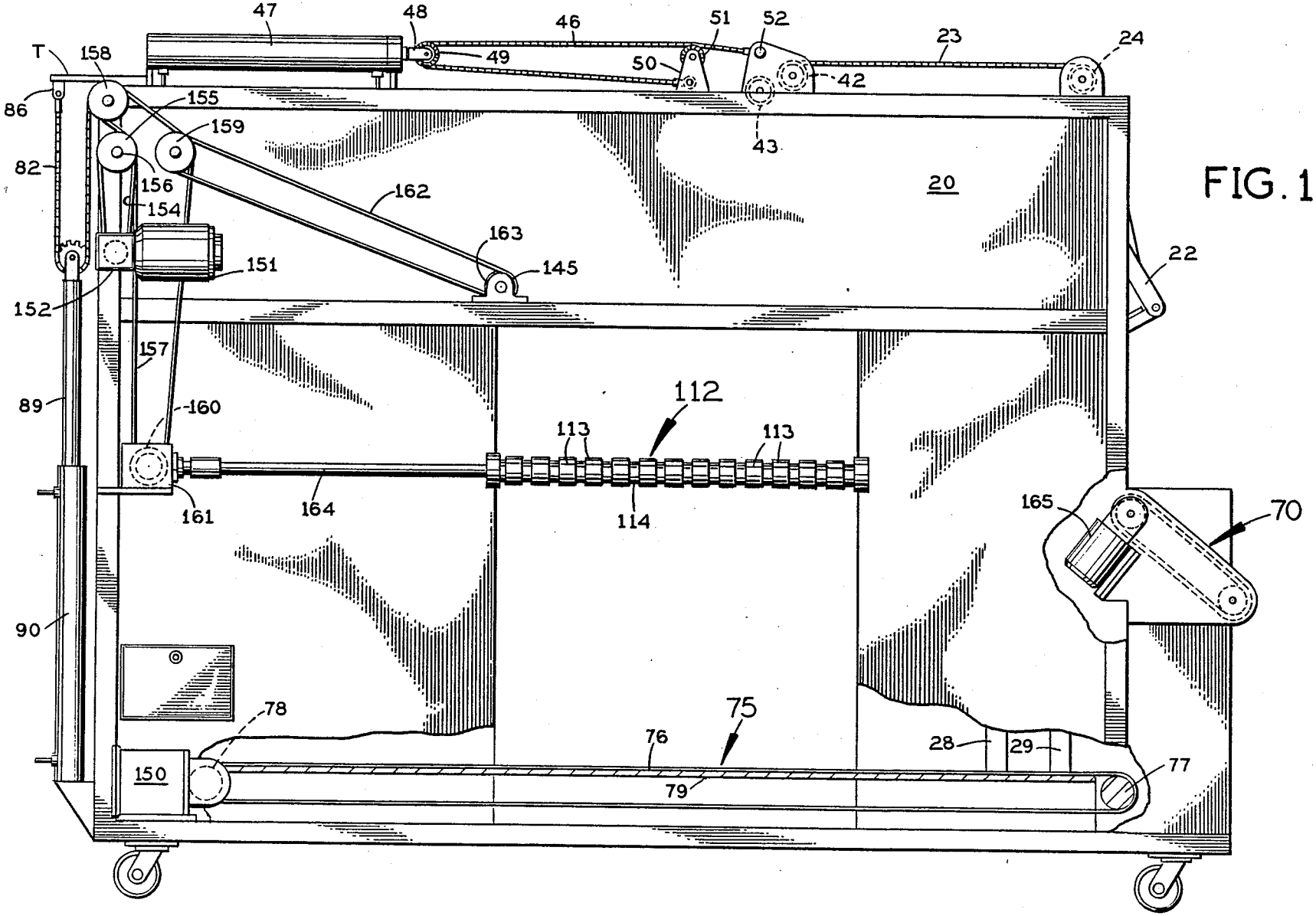
FIG. 1 is an elevational view of the present apparatus with parts broken away for clarity.
Figure 10:
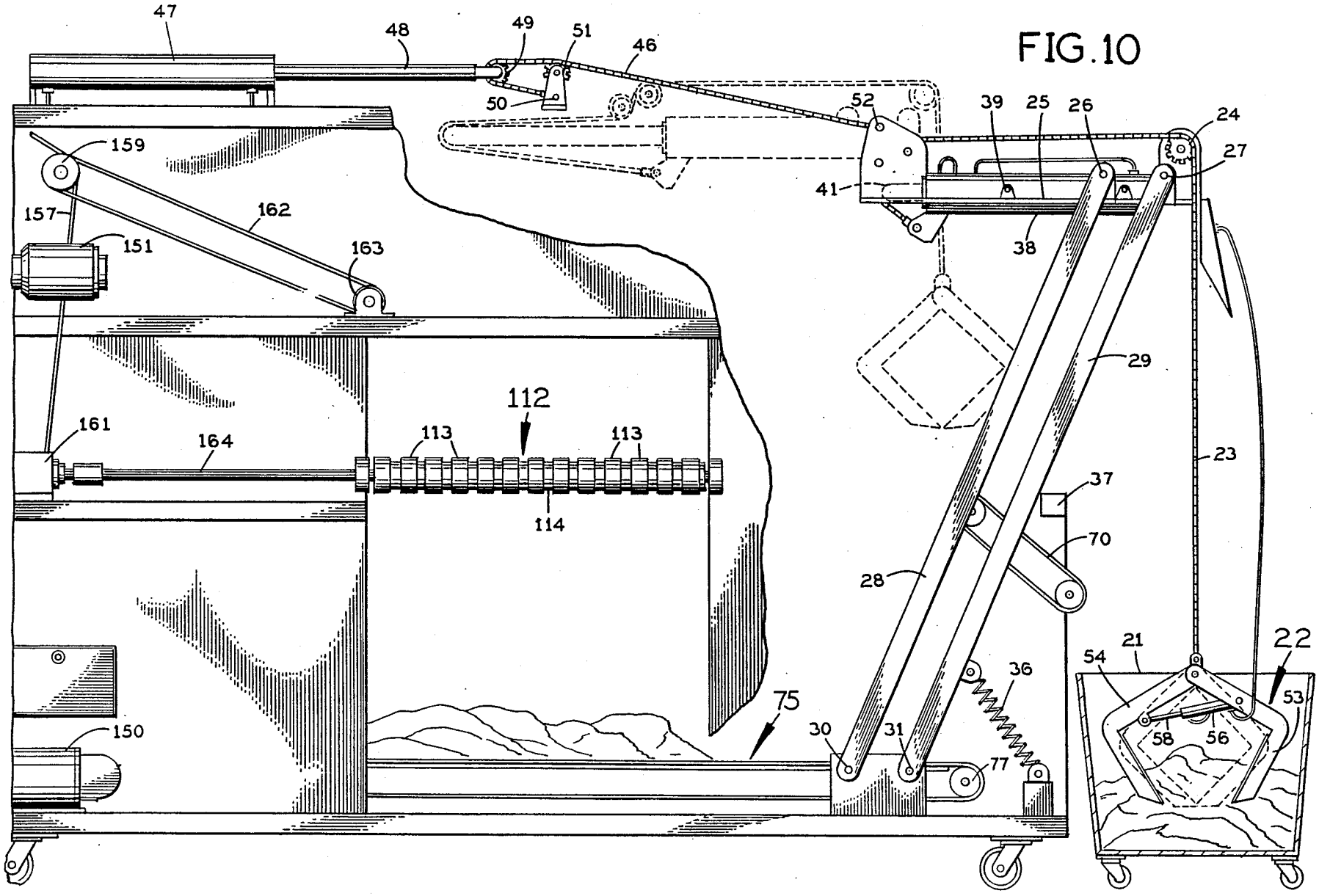
FIG. 10 is an elevational view of the mechanism inside the apparatus, including the FIG. 6 entry clamp, for picking up a pile of laundry articles at the entry end of the apparatus.

Referring to FIG. 1, the apparatus has a generally rectangular housing 20 whose right end in this Figure is the entry end, i.e., the end at which a pile of laundry articles. usually tangled, enter the apparatus to be separated into individual articles before leaving, either at the front or the rear side about midway between its ends in FIG. 1. As shown in FIG. 10, the laundry articles to be separated may be in a wheeled bin 21 next to the entry end of the apparatus.

ENTRY CLAMP

Figure 2:
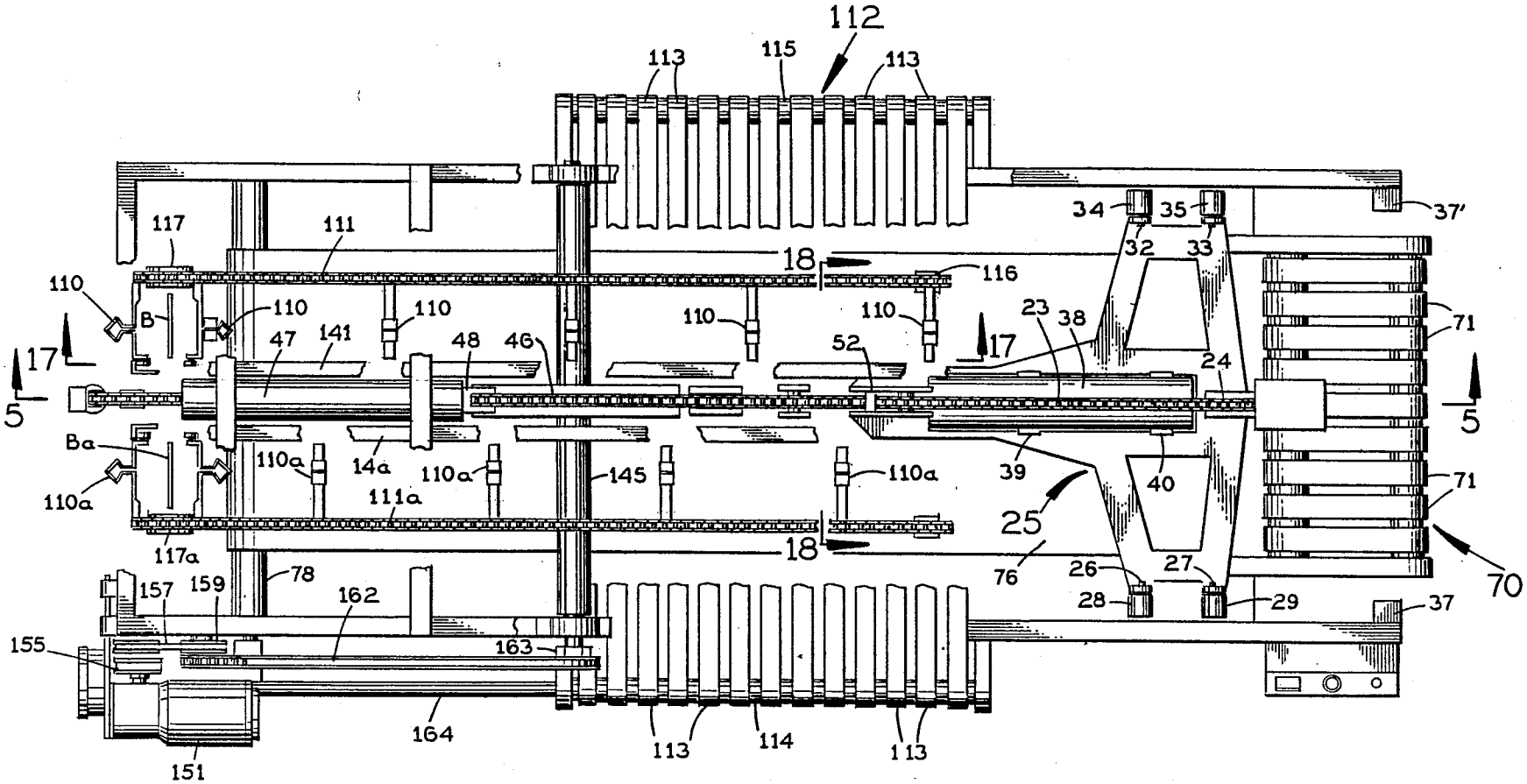
FIG. 2 is a top plan view of the apparatus with the top cover removed and certain parts broken away for clarity.
Figure 3:
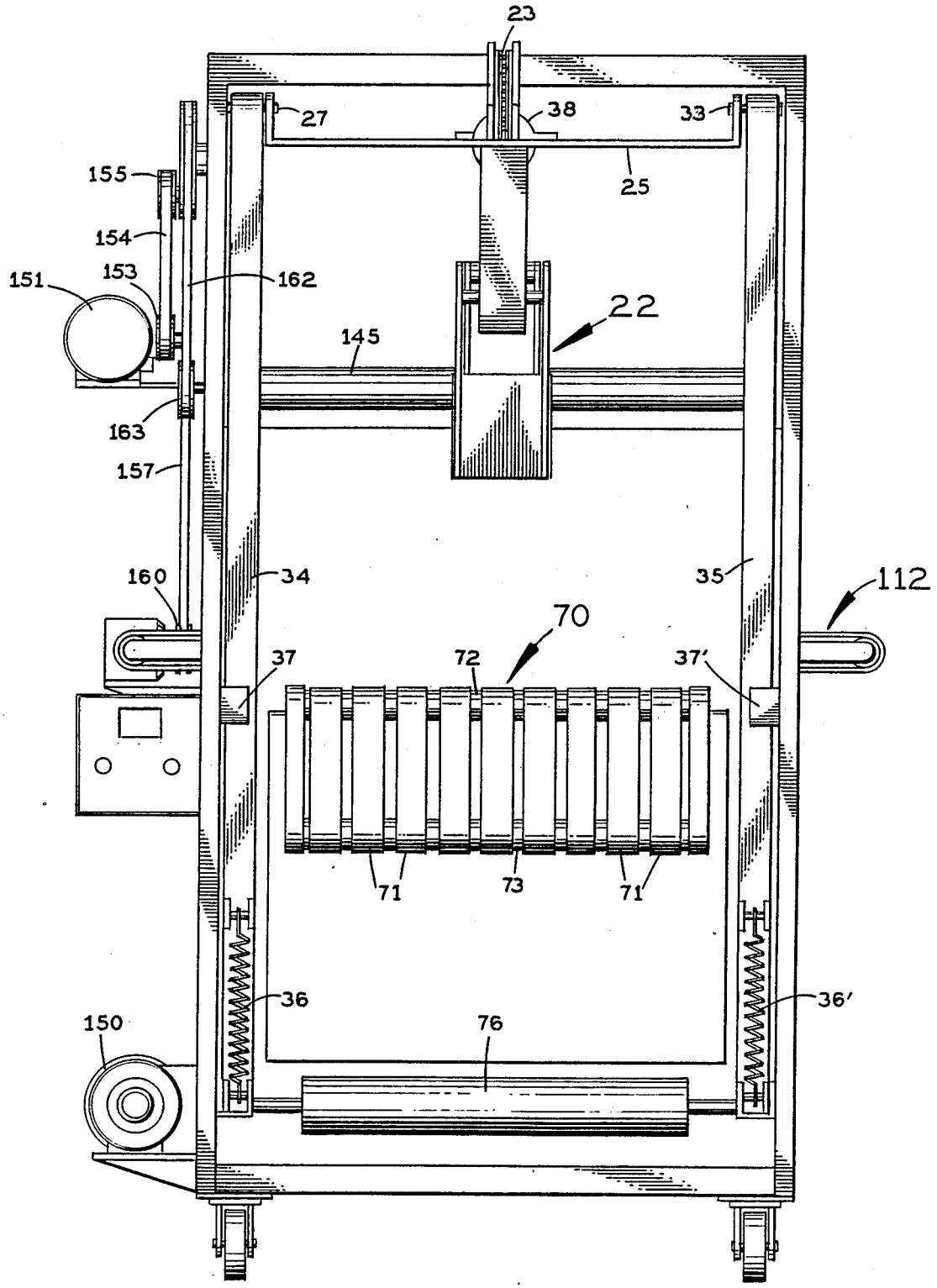
FIG. 3 is an end elevation of the apparatus at its entry end.

An entry clamp 22 of the apparatus is suspended from a chain 23 which hangs down from a horizontal pulley 24 on a carrier 25, which is movable lengthwise of the apparatus (from left to right and vice versa in FIGS. 1 and 2). As shown in FIG. 2, carrier 25 extends horizontally on opposite sides of chain 23. On one side of the chain (below it in FIG. 2), the carrier 25 is pivotally connected at 26 and 27 to the upper ends of a pair of rigid arms 28 and 29 (FIG. 10), the lower ends of which are pivoted at 30 and 31 to a fixed part of the housing or framework of the apparatus. On the opposite side of chain 23 (above it in FIG. 2), the carrier 25 is pivotally connected at 32 and 33 (FIG. 3) to an identical pair of arms 34 and 35, the lower ends of which are fixedly pivoted in the same manner as arms 28 and 29. A tension spring 36 (FIGS. 10 and 3) acts between the framework of the apparatus and arm 29 to bias the arms 28 and 29 clockwise to the position, shown in FIG. 10, where arm 29 engages a horizontal stop 37 on the housing or framework of the apparatus. A similar spring 36′ (FIG. 3) acts on arm 35 at the opposite side of carrier 25, pulling it in the same direction against a stop 37′ on that side.

Figure 5:
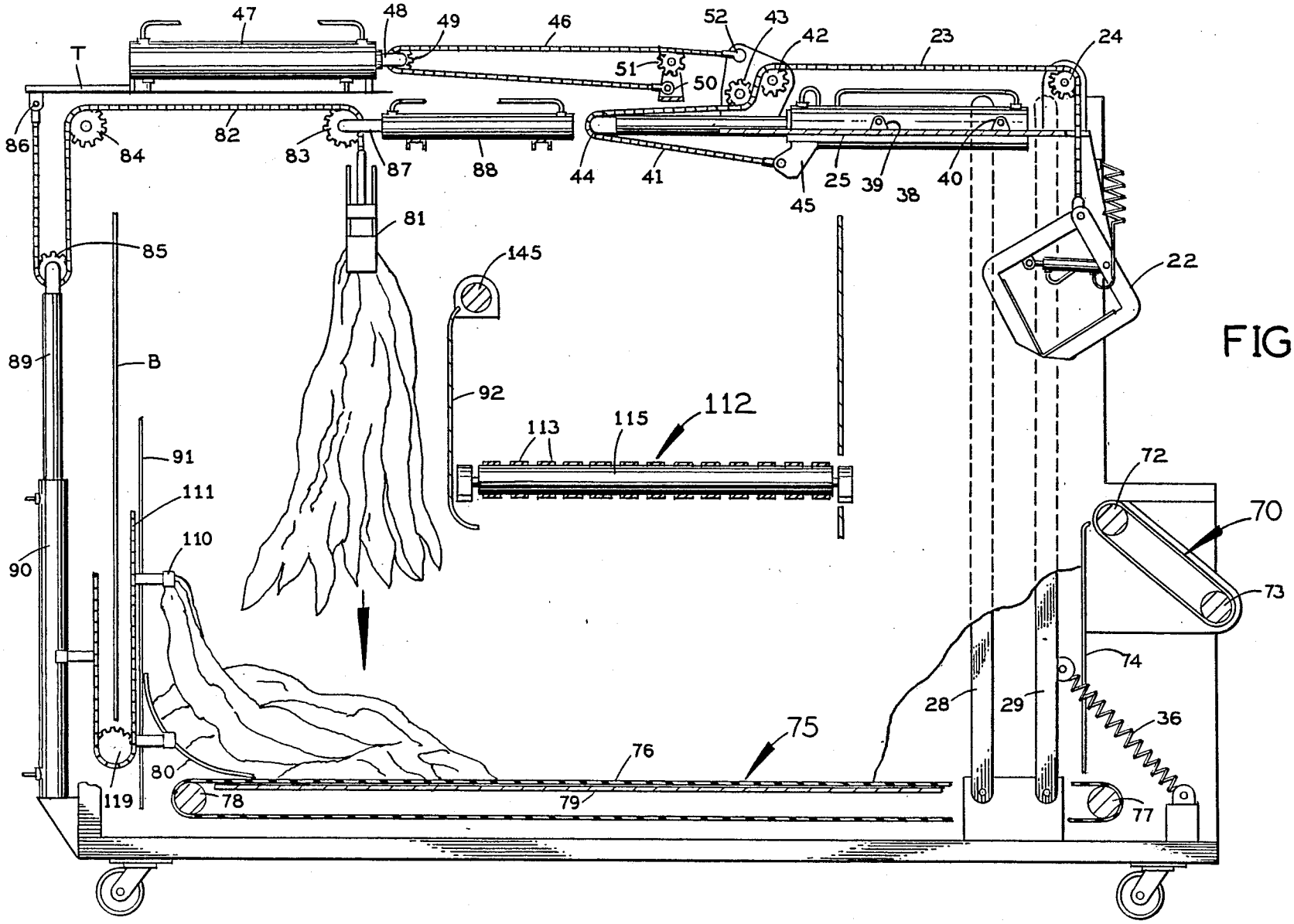
FIG. 5 is a vertical longitudinal section taken along the line 5—5 in FIG. 2.

The carrier 25 for inlet clamp 22 supports an air cylinder 38 (FIGS. 2 and 5) at horizontal pivots 39 and 40 on each side of the cylinder towards its opposite ends. Cylinder 38 extends horizontally along the longitudinal centerline of the apparatus directly below the chain 23 for inlet clamp 22. A reciprocable piston (not shown) in cylinder 38 has a piston rod 41 (FIG. 5) that extends from the left end of cylinder 38. As best seen in FIG. 5, chain 23 extends horizontally to the left from pulley 24 above the air cylinder 38, across the top of an idler sprocket 42, down beneath a nearby idler sprocket 43, and down around a sprocket 44 on the outer end of piston rod 41 to a bracket 45 affixed to the bottom of carrier 25.

With this arrangement, the entry clamp 22 on chain 23 is lowered and raised by the air cylinder 38. For example, as shown in FIG. 10, clamp 22 is lowered when piston rod 41 is retracted into air cylinder 38 and, as shown in FIG. 5, clamp 22 is raised when piston rod 41 is extended from the air cylinder 38.

The position of carrier 25 and air cylinder 38 longitudinally of the apparatus, and thus the angular or pivotal positions of arms 28,29,34 and 35, is determined by a second chain 46 operated (FIG. 1) by a second air cylinder 47, which extends horizontally along the longitudinal centerline of the apparatus near its opposite end from the entry end. Cylinder 47 has a piston (not shown) with a piston rod 48 extending from this cylinder toward the entry end of the apparatus. Chain 46 passes around a pulley 49 on the outer end of this piston rod. One end of chain 46 is anchored to a fixed support 50 located slightly below the pulley 49 on the outer end of piston rod 48 and toward the entry end of the apparatus (to the right of pulley 49 in FIG. 1). Chain 46 passes over a guide sprocket 51 on the upper end of support 50. The upper right end of chain 46 in FIGS. 5 and 10 is connected at 52 to the carrier 25.

With this arrangement, when air cylinder 47 is operated to extend piston rod 48, as shown in FIG. 10, it permits springs 36 and 36′ to pull the carrier 25 toward the entry end of the apparatus (to the right in FIGS. 5 and 10). When air cylinder 47 retracts piston rod 48, as shown in FIG. 5, it pulls carrier 25 away from the entry end of the apparatus (to the left in FIGS. 5 and 10) and causes the pivoted arms 28,29,34 and 35 to move counterclockwise from the FIG. 10 position to the FIG. 5 position.

Figure 6:
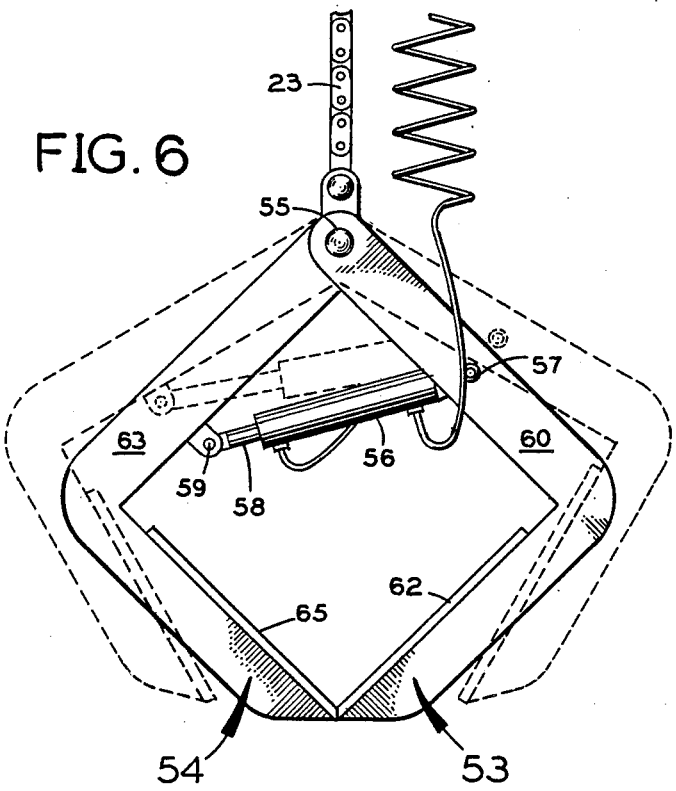
FIG. 6 is a front elevation of the entry clamp for picking up laundry articles from a pile at the entry end of the apparatus and then dropping them onto a lower conveyor which carries them toward the opposite end of the apparatus.

As best seen in FIG. 6, the entry clamp 22 on the lower end of chain 23 has an opposed pair of right-angled jaws 53 and 54, both having their upper ends pivoted at 55 to the lower end of the chain. An air cylinder 56 on the entry clamp is pivoted at 57 to the upper leg of jaw 53. A piston reciprocable in this cylinder has a piston rod 58 whose outer end is pivotally connected at 59 to the upper leg of jaw 54. When cylinder 56 is operated to retract piston rod 58, the lower ends of jaws 53 and 54 are closed, as shown in full lines in FIG. 6. When cylinder 56 is operated to move piston rod 58 to an extended position, shown in phantom in FIG. 6, the lower ends of jaws 53 and 54 are spread apart.

Figure 7:
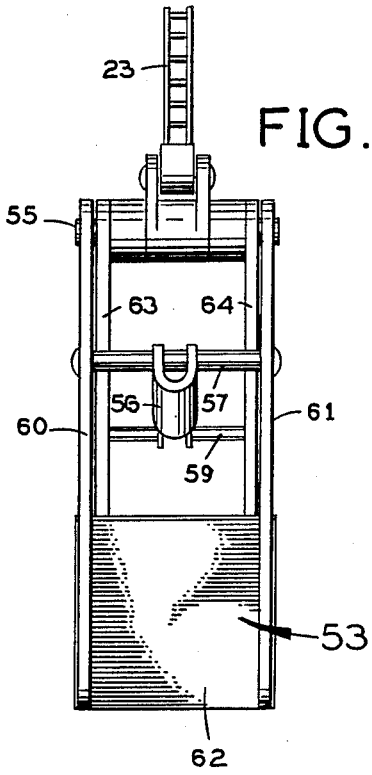
FIG. 7 is an end elevation of the entry clamp shown in FIG. 6.

As shown in FIG. 7, jaw 53 has a pair of laterally spaced, vertical members 60 and 61, each of right-angled configuration as shown for member 60 in FIG. 6, and a generally flat plate 62 extending between these members on the inside of the lower leg of each. The other jaw 54 has the same construction, with two laterally spaced vertical members 63 and 64 (FIG. 7) and a generally flat plate 65 (FIG. 6) extending between their lower legs on the inside. Plates 62 and 65 have teeth to enhance their grip on laundry articles engaged by the respective jaws 53 and 54 of the entry clamp. A cross pin 57 extends between members 60 and 61 of jaw 53 and pivotally supports one end of cylinder 56. A cross pin 59 supported by the opposite members 63 and 64 of jaw 54 pivotally supports the outer end of piston rod 58.

The housing of the apparatus has a vertical wall 74 (FIG. 5) extending down form a location immediately behind the upper end of an entry conveyor 70 to a location close to one end of a horizontal lower conveyor 75. This wall insures that after being released by the raised entry clamp 22 (FIG. 11) and carried up by the entry conveyor 70 the laundry articles will drop onto the conveyor 75.

LOWER CONVEYOR

The lower conveyor 75 has a single, flexible endless belt 76 (FIG. 2) extending around a horizontal idler roller 77 (FIG. 1) near the entry end of the apparatus and a horizontal motor-driven roller 78 near the opposite end of the apparatus. The upper run of conveyor belt 76 is from right to left in these FIGS. i.e., from the entry end toward the opposite end of the apparatus, and it slides across the top of a horizontal guide plate 79 (FIG. 2). Therefore, the lower conveyor 75 carries the laundry articles dropped on it by the entry clamp 22 near the entry end of the apparatus over toward the opposite end of the apparatus, i.e. from right to left in FIG. 12. A curved plate 80 extends up from the top of conveyor 75 near the aforesaid opposite end of the apparatus and provides a limit stop against which the laundry articles pile up after being carried by this conveyor from near the entry end of the apparatus.

ENTRY CONVEYOR

The entry conveyor 70 is located just inward from the entry end of the apparatus. As shown in FIG. 2, conveyor 70 has a plurality of flexible endless belts 71 closely spaced apart laterally and passing over a motor-driven, horizontal, upper roller 72 (FIG. 11) and a horizontal lower idler roller 73. As indicated by the arrow in FIG. 11, the upper run of the conveyor belts 71 is at an acute angle upward and into the apparatus from its entry end. The conveyor 70 carries the laundry articles up and into the apparatus from its entry end. Each belt 71 of conveyor 70 has laterally extending raised ribs and grooves in alternating sequence along its length to minimize slippage of the laundry articles on the conveyor as it moves them up into the apparatus.

OPERATION AT ENTRY END OF THE APPARATUS

Figure 11:
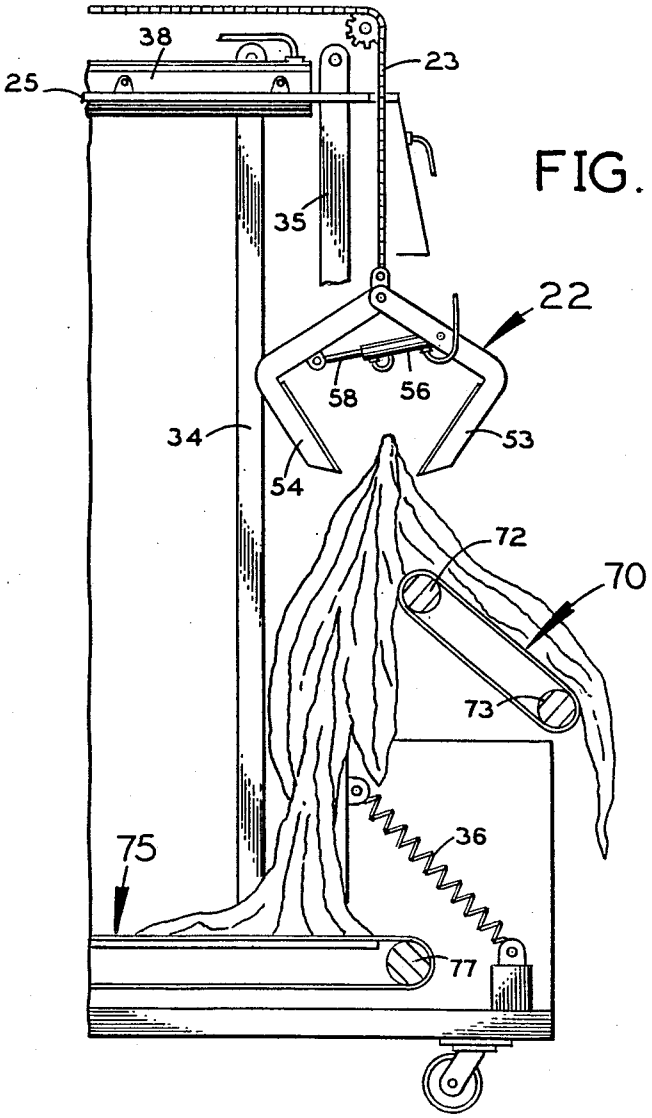
FIG. 11 is a fragmentary elevational view of this mechanism after it has picked up the laundry articles and dropped them onto an entry conveyor in the apparatus.

The sequence of operation for the entry clamp 22 and the entry conveyor 70 is as follows:

Starting with the parts in the position shown in FIG. 5, first, cylinder 47 is actuated to extend its piston rod 48. Springs 36 and 36' pull the pivoted arms 29 and 35 clockwise in this Figure, causing the carrier 25 to move toward the entry and of the apparatus, from the phantom line position in FIG. 10 to the slightly lower full line position in this Figure. Next, cylinder 38 is actuated to retract its piston rod 41 to the full line position in FIG. 10. The weight of entry clamp 22 pulls its chain 23 down and the clamp is lowered until it engages the pile of wet laundry articles just outside the entry end of the apparatus. When this happens, chain 23 goes slack and this is sensed by a limit switch (not shown) that causes the clamp cylinder 56 to extend its piston rod 58 and thereby open the clamp jaws 53 and 54, as shown in full lines in FIG. 10. Then, cylinder 56 is actuated to close its jaws 53 and 54 to grasp between them several of the wet laundry articles in the pile and cylinder 38 is actuated to extend its piston rod 41, thereby pulling chain 32 up and raising the entry clamp 22. Then, cylinder 47 is actuated to retract its piston rod 48 and pull the carrier 25 away from the entry end of the apparatus and toward the phantom line position in FIG. 10. This moves the entry clamp to a position above one end of the lower horizontal conveyor 75, as shown in phantom in FIG. 10 and in full lines in FIG. 5. A limit switch (not shown) senses the full retraction of piston rod 48 and actuates the clamp cylinder 56 to extend its piston rod 58, spreading its jaws 53 and 54 apart so that they release the laundry articles (FIG. 11).

The trailing part of the group of laundry articles raised and then dropped by the entry clamp 22 engages the upwardly and inwardly moving inlet conveyor 70, which carries the released laundry articles into the apparatus and drops them onto the lower conveyor 75.

SEPARATOR CLAMP

Near the opposite end of the apparatus from its entry end a vertically reciprocable separator clamp 81 (FIG. 5) located above the curved baffle plate 80 picks up a few laundry articles from the lower conveyor, raises them and then drops them back onto this conveyor to loosen and separate them. This clamp is on the lower end of a chain 82 which passes over a horizontally reciprocable pinion 83 and a fixed horizontal pinion 84 at the same height as pinion 83, and down from pinion 84 and up under a vertically reciprocable pinion 85 to a fixed support 86 on the top T of the housing or framework of the apparatus. Chain 82 extends along the longitudinal centerline of the apparatus below cylinder 47. Pinion 83 is on the outer end of a piston rod 87 attached to a piston (not shown) that is slidable in a horizontal air cylinder 88 fixedly suspended from the top T of the housing. Pinion 85 is on the outer end of a piston rod 89 attached to a piston slidable in a vertical air cylinder 90.

Figure 12:
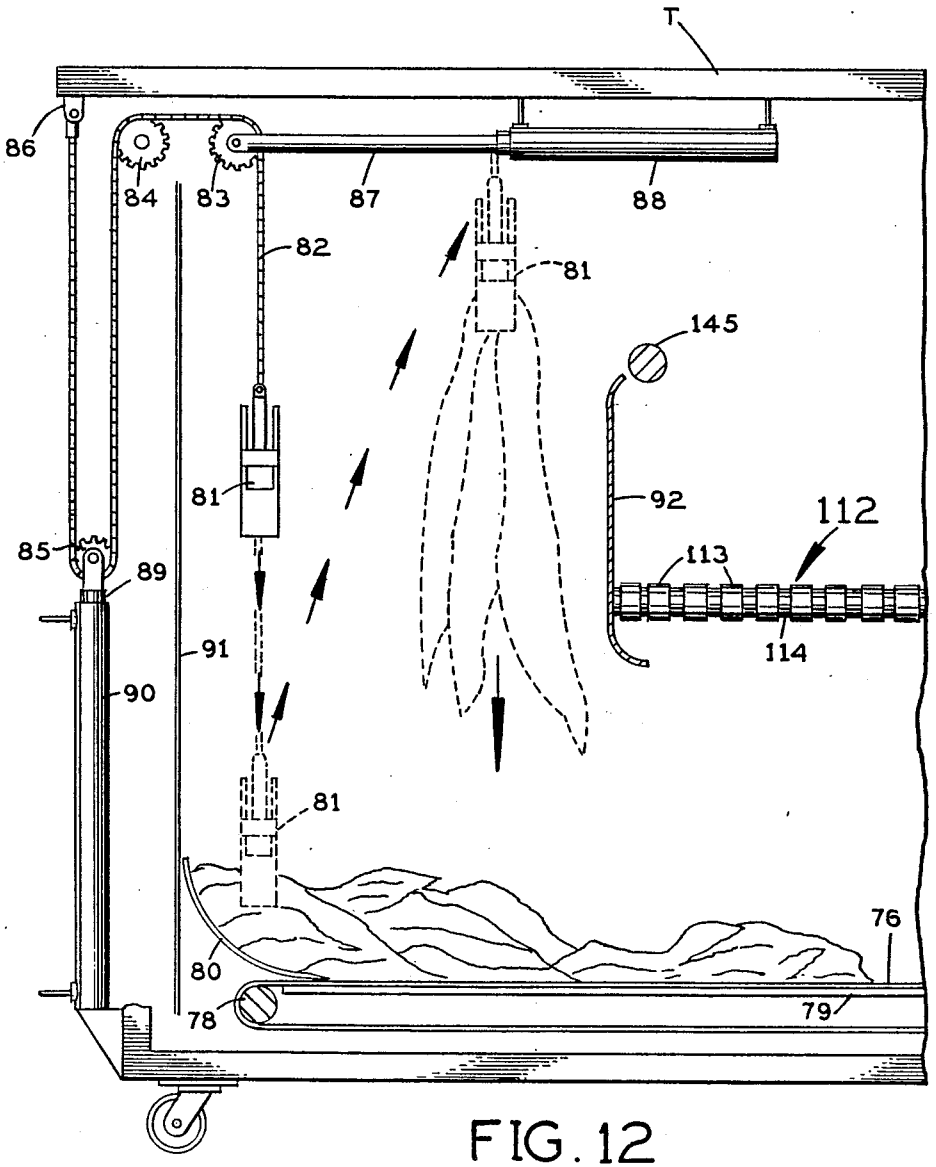
FIG. 12 is an elevational view of the mechanism inside the apparatus, including the FIG. 8 clamp, for picking up and dropping smaller numbers of laundry articles near the opposite end of the apparatus from its entry end to separate these laundry articles.

Starting with the parts in the positions shown in FIG. 12, with horizontal piston rod 87 extended and vertical piston rod 89 retracted, the separator clamp 87 is lowered when the vertical cylinder 90 is actuated to extend its piston rod 89. Separator clamp 81 drops to the position shown in phantom at the lower left of this Figure and picks up a few laundry articles in the pile next to the curved baffle plate 80.

Next, the separator clamp 81 is raised and moved from left to right in FIG. 12 to the position shown in phantom at the upper middle of that Figure and in full lines in FIG. 5. This is done by actuating the horizontal cylinder 88 to retract its piston rod 87. This movement of separator clamp 81 tends to loosen and separate the laundry articles in its grasp.

Following this, the raised separator clamp 81 releases the laundry articles and they drop again on the lower conveyor 76, which carries them again to the curved baffle plate 80 where they tend to ride up its concave surface and then drop back down, an action which tends to separate them more.

During this operation, the laundry articles hanging down from separator clamp 81 are confined between interior vertical walls 91 and 92 (FIG. 12) of the apparatus. Wall 91 extends up from the curved baffle plate 80. Wall 92 is located closer to the entry end of the apparatus.

Figure 8:
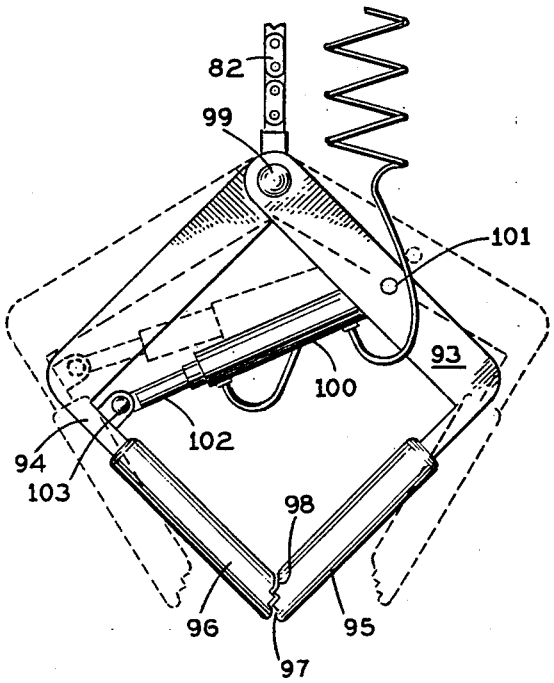
FIG. 8 is a front elevation of the separator clamp near the opposite end of the apparatus for picking up laundry articles from the lower conveyor and dropping them again on that conveyor.
Figure 9:
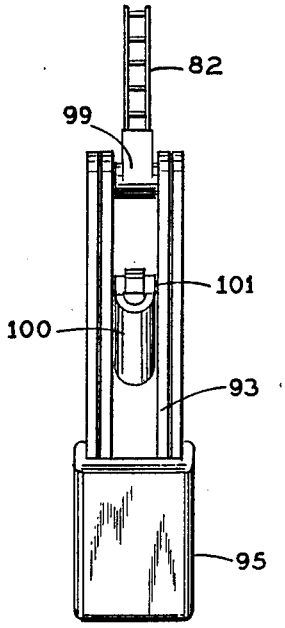
FIG. 9 is an end of elevation of the separator clamp shown in FIG. 8.

FIGS. 8 and 9 show the separator clamp 81 in detail. It has two opposed right-angled jaws 93 and 94, carrying respective plastic sleeves 95 and 96 on their lower legs with saw-toothed tips 97 for gripping laundry articles between them. The jaws are pivoted at their upper ends, at 99, to the lower end of chain 82. An air cylinder 100 is pivotally attached at 101 to the upper leg of jaw 93. A piston slidable in this cylinder is joined to a piston rod 102, the outer end of which is pivotally connected at 103 to the opposite jaw 94 near the juncture between its upper and lower legs. When air cylinder 100 is actuated to retract its piston rod 102, the jaws 93 and 94 of separator clamp 81 are closed, as shown in full lines in FIG. 8. When cylinder 100 is actuated to extend its piston rod 102, it spreads the jaws 93 and 94 apart, as shown in phantom in FIG. 8.

REMOVAL CLAMPS

After the separated laundry articles have been dropped back onto the lower conveyor 75 by separator clamp 81, they are picked up individually by removal clamps 110 (FIG. 5) and **110*a* (FIG. 2) on respective endless chains 111 and 111*a* and carried to a position above an exit conveyor 112 located on the side of interior wall 92 toward the entry end of the apparatus and past a motor-driven horizontal roller 145. As shown in FIG. 1, exit conveyor 112 is located about midway between the entry end of the apparatus and the opposite end and, as shown in FIG. 5, it is about halfway between the bottom and the top of the apparatus. The exit conveyor has a plurality of closely spaced endless flexible belts 113 extending around horizontal rollers 114 and 115 on the opposite sides of the apparatus. Rollers 114 and 115** are elongated lengthwise of the apparatus.

Figure 4:
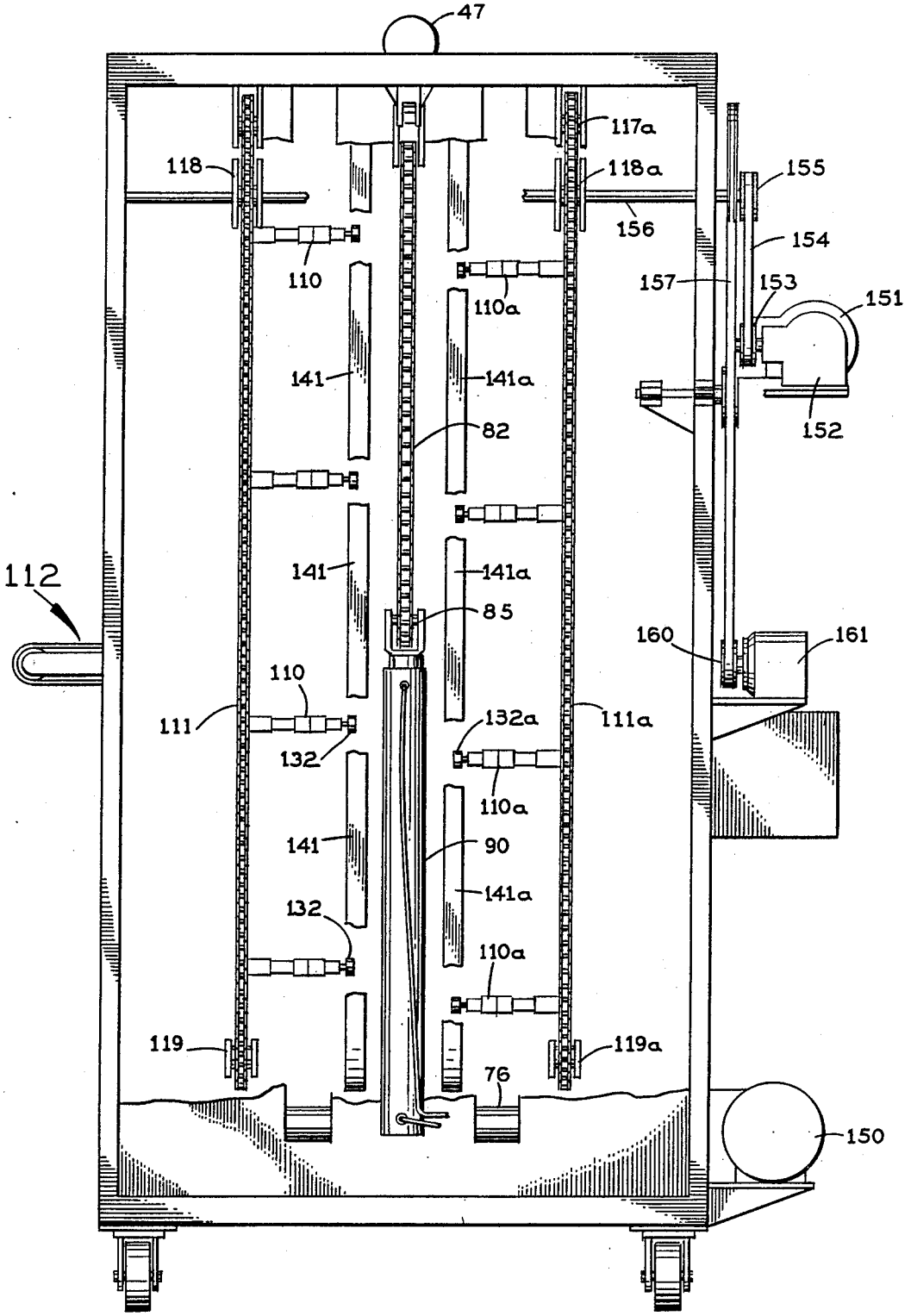
FIG. 4 is a similar view of the opposite end of the apparatus.

As shown in FIGS. 2 and 4, the endless chains 111 and **111*a* are spaced laterally on opposite sides of the longitudinal centerline of the apparatus and they run down and then up on opposite sides of the curved baffle plate 80 at the exit end of lower conveyor 75 and on opposite sides of the vertical interior wall 91. There is enough lateral separation at all times between the separator clamp 81, which moves along the longitudinal centerline of the apparatus, and each of the removal clamps 110 and 110***a* on opposite sides of it that there is no interference among them, and the separator clamp can operate simultaneously with the removal clamps, with the separator clamp picking up laundry articles in the middle of the pile of articles next to baffle plate 80 and the removal clamps pick up laundry articles near the opposite sides of this pile, where they tend to separate more readily than in the middle of the pile.

Figure 17:
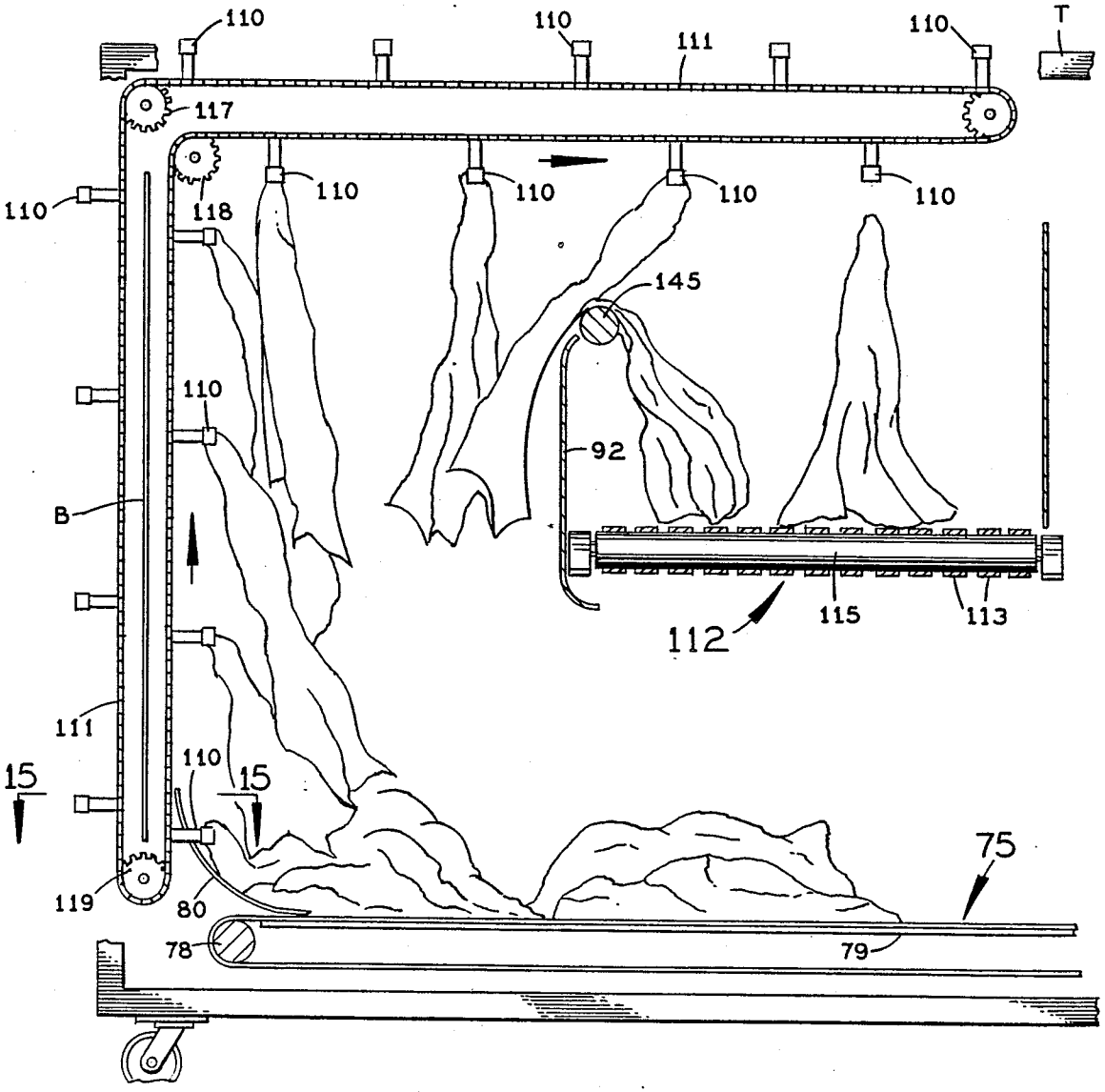
FIG. 17 is a partial longtitudinal vertical section taken along the line 17—17 in FIG. 2, with parts omitted for clarity.

As shown in FIG. 17, chain 111 extends around a sprocket 116 which is positioned closer to the entry end of the apparatus than to the opposite end of the apparatus, then over an outer, upper corner sprocket 117 and an inner lower corner sprocket 118, both located near the opposite end of the apparatus close to the top, and then around a bottom sprocket 119 located vertically below sprocket 117 and a short distance above and beyond the end of lower conveyor 75 closest to the opposite end of the apparatus. The chain 111 is driven in a direction such that it moves from the bottom sprocket 119 up to the lower corner sprocket 118, and from sprocket 118 horizontally to sprocket 116, returning from sprocket 116 horizontally to the outer, upper corner sprocket 117, and passing down around sprocket 117 to the lower sprocket 119.

The other chain 111*a* has an identical drive arrangement and it moves in unison with chain 111.

Baffles B and Ba (FIGS. 2,5 and 17) extend vertically up from the lower sprockets 119 and 119*a* between the "down" and "up" runs of the respective chains 111 and 111*a* to reduce the possibility that a laundry article in the grasp of a removal clamp 110 or 110*a* will get caught in the chain. Preferably, each baffle B or, Ba is a thin brush with long bristles extending substantially parallel to the "down" and "up" runs of the corresponding chain.

Figure 13:
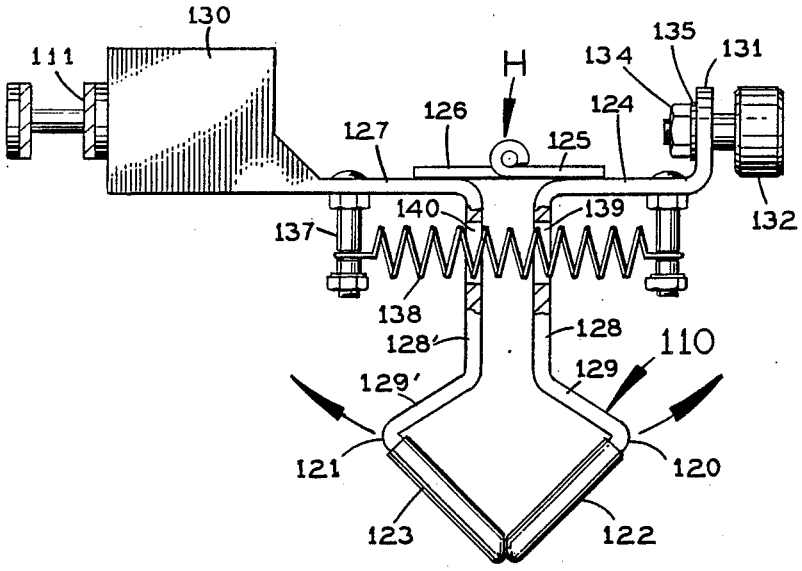
FIG. 13 is a fragmentary elevational view of one of the removal clamps for picking up a single laundry article from the lower conveyor and carrying it to an exit conveyor.
Figure 14:
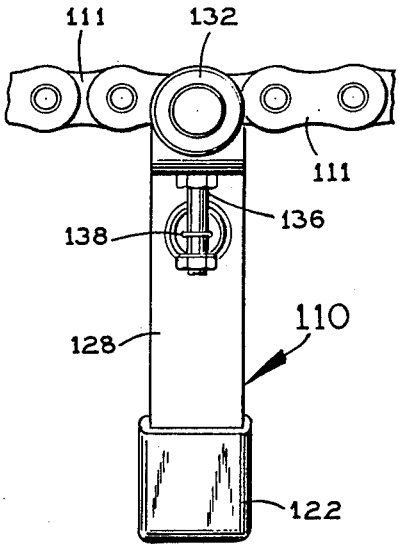
FIG. 14 is an end elevation of the FIG. 13 removal clamp.

Each removal clamp 110 is constructed as shown in detail in FIGS. 13 and 14. It has opposed, pivoted jaws 120 and 121, with respective plastic sleeves or sheaths 122 and 123 on their free outer ends. Jaw 120 has a flat inner segment 124 welded to one plate 125 of a hinge which has its other plate 126 welded to the iner end segment 127 of jaw 121. Jaw 120 has an intermediate flat segment 128 extending perpendicularly out from its inner segment 124, an arm 129 extending out from the outer end of segment 128 at an angle of about 130 degrees, and an outer end segment extending from the outer end of arm 129 at an angle slightly less than 90 degrees and carrying the protective sheath 122. Jaw 121 is a mirror image of jaw 120 and its elements 128' and 129' correspond to the similarly numbered elements of jaw 120.

The inner end segment 127 of jaw 121 is joined to a block 130 that is attached to chain 111. The inner end segment 124 of jaw 120 is joined to a flange 131 extending perpendicular to it and rotatably supporting a roller 132. Roller 132 is on an axle 133 extending perpendicular to flange 131 and clamped to it by a nut 134 and a washer 135. A pair of posts 136 and 137 are mounted respectively on the inner end segments 124 and 127 of jaws 120 and 121. A coil spring 138 is attached to these posts at its opposite ends and passes freely through openings 139 and 140 in the intermediate segments 128 and 128' of the jaws. This spring is under tension and it biases jaw 120 to the position shown in FIG. 13 with sufficient force to hold a very wet king-sized bed sheet, for example, suspended from the removal clamp. However, if the wet laundry article, such as a bedsheet, grasped by the removal clamp is severely tangles with another laundry article hanging down from the laundry article that is in the grasp of the removal clamp, the combined weight of the two laundry articles is enough to cause the removal clamp to release them without tearing or otherwise damaging the laundry article grasped by the removal clamp. The tension of spring 138 in removal clamp 110 may be adjusted to increase or decrease its clamping force by turning either post 136 or 137 in one direction or the other.

Figure 15:
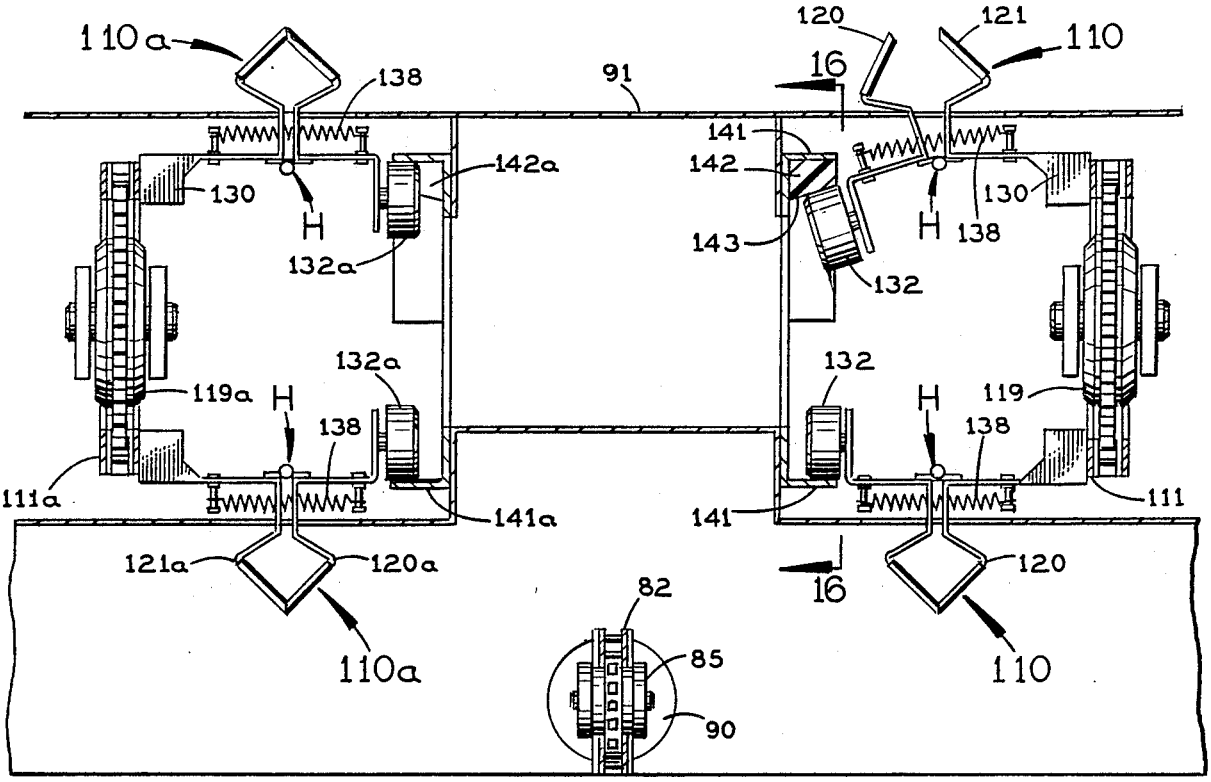
FIG. 15 is a horizontal cross-section taken along the line 15—15 in FIG. 17 and showing removal clamps as shown in FIG. 13 and cams for opening these clamps just before they pick up single laundry articles and carry them over to the exit conveyor.

As shown in FIG. 15, roller 132 rides along a fixed endless track 141 of right-angled cross-section, which extends parallel to and outside the endless chain 111 along the complete length of that chain. That is, in FIG. 17, the track 141 extends below the chain at the bottom sprocket 119, to the right of the chain along its path up from sprocket 119 to the inside corner sprocket 118, below the chain along its path to the right from sprocket 118 to sprocket 116, around the outside of sprocket 116, above the chain in its path from sprocket 116 to the upper corner sprocket 117, around the outside of sprocket 117, and down from sprocket 117 to bottom sprocket 117 outside the chain. Therefore, throughout the endless travel of each removal clamp 110 with the chain 111, the roller 132 on that clamp rides along the endless track 141.

Normally, the jaws 120 and 121 of each removal clamp 110 are closed as the chain carries it along this endless path. However, at two locations along track 141 the jaws of the removal clamp are opened automatically: first, just before the clamp picks up a laundry piece next to the curved plate 80 at the end of lower conveyor 75, and second, when the clamp drops the laundry piece onto roller 145.

Figure 16:
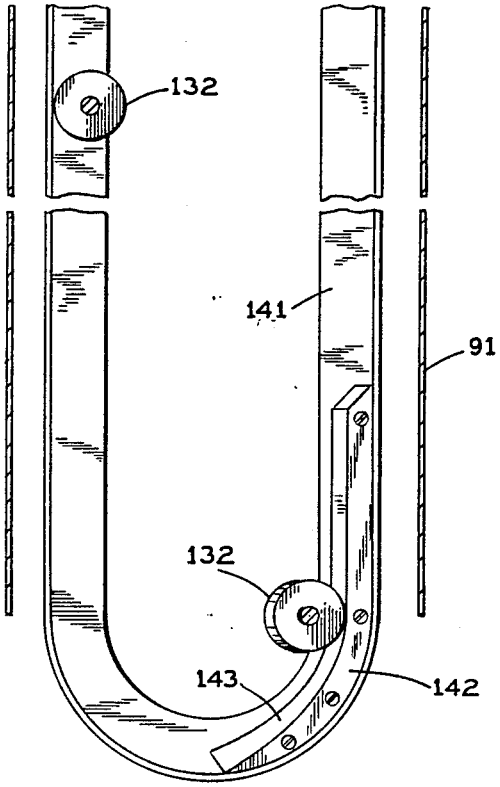
FIG. 16 is a fragmentary vertical cross-section taken along the line 16—16 in FIG. 15.

Referring to FIG. 16, the track 141 has a fixed cam 142 on the inside where it passes up around the bottom sprocket 119 for chain 111. Cam 142 is an opening cam for opening and holding open each removal clamp 110 as it reaches the laundry articles piled against the curved baffle plate 80. Roller 132 rolls along the inside surface 143 of this cam and, as shown in FIG. 15, this rocks the clamp jaw 120 about the pivotal axis of hinge H away from the opposite jaw 121 in this clamp, so that the free ends of these jaws are apart as this removal clamp moves up past the laundry articles piled next to the curved baffle plate 80 in FIG. 5. When roller 132 moves up past the cam 142, the clamp jaw 120 pivots back toward the opposing jaw 121 under the influence of spring 138, and the free ends of these jaws close on a single laundry article and pick it up from the pile as the chain 111 continues to move this removal clamp up past the pile.

Figure 18:
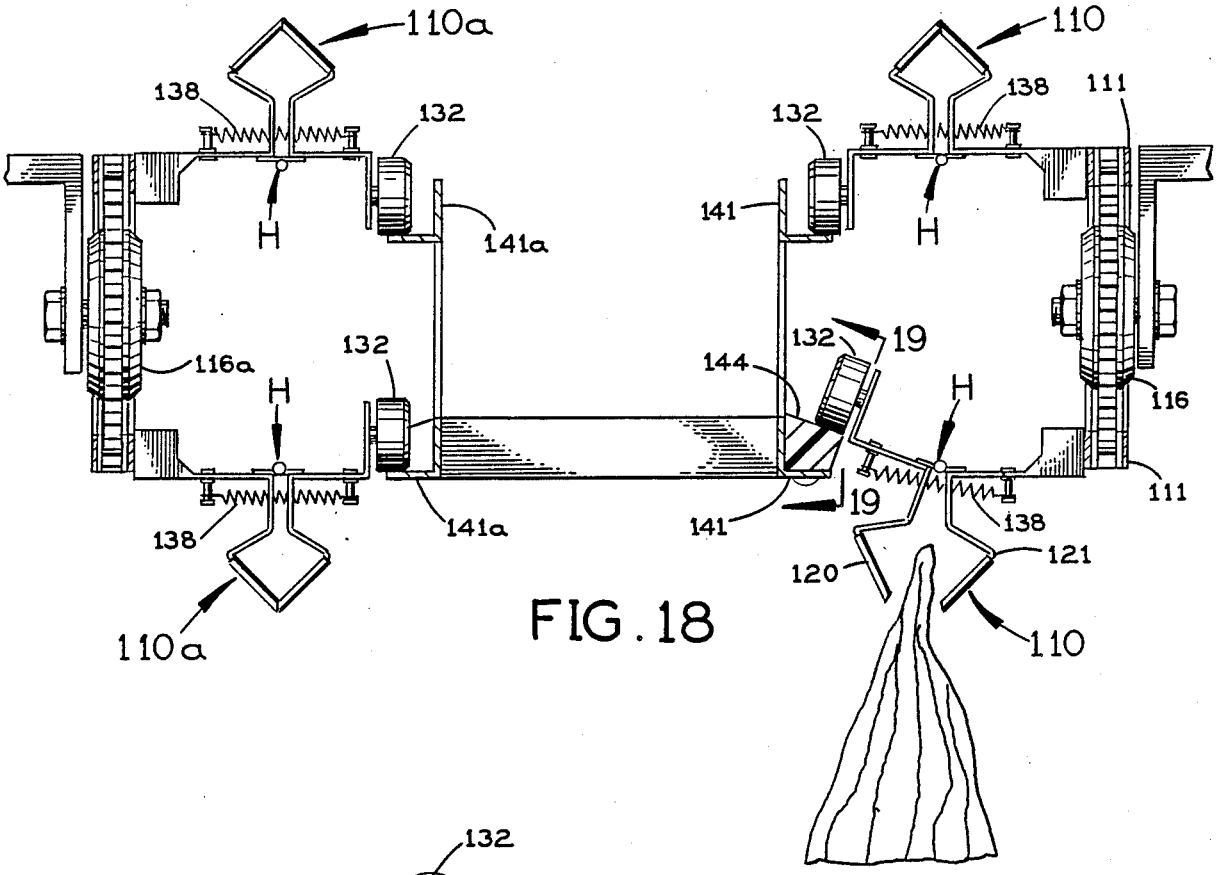
FIG. 18 is a partial vertical cross-section taken along the line 18—18 in FIG. 2.
Figure 19:
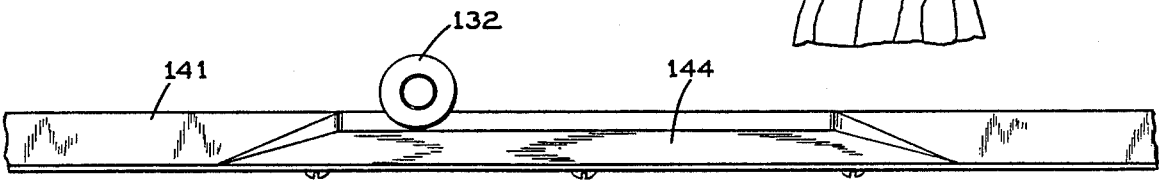
FIG. 19 is a fragmentary section taken along the line 19—19 in FIG. 18.

The track 141 has a similar cam 144 (FIGS. 18 and 19) on the inside a short distance before the chain sprocket 116 along the course of movement of chain 111 from the inside corner sprocket 118 to sprocket 116. This cam is a release cam that is engaged by roller 132 and which causes the removal clamp 110 to release the laundry article and drop it onto the exit conveyor 112 below, as indicated in FIGS. 17 and 18.

As shown in FIG. 17 the horizontal motor-driven roller 145 is located just above the top of interior wall 92 and toward the entry end of the apparatus. A laundry article hanging down from removal clamp 110 engages this roller, which rotates clockwise in FIG. 17 to insure that the entire laundry article moves up past wall 92 and is deposited on the exit conveyor 112.

Ideally, the removal clamp 110 does not release the laundry article until its roller 132 engages cam 142, so that most of the laundry article is well past roller 145 and over the exit conveyor. However, in some instances the weight of the laundry article as the removal clamp 110 drags it over roller 145 will cause clamp 110 to release it prematurely, i.e., before roller 132 reaches cam 144. In that case, the roller 145 will move the released laundry article over the interior wall 92 and drop it onto the exit conveyor 112. The same action takes place if the laundry article in the grasp of removal clamp 110 is somewhat tangled with another laundry article.

Each removal clamp 110*a* on the other chain 111*a* has the same construction and mode of operation as claim 110 and a similar track extends around chain 111*a* to guide the movement of each removal clamp 110*a* and to open and close each removal clamp 110*a* at the same locations along the path of chain 111*a*. The removal clamps 110*a* on chain 111*a* are staggered or offset with respect to the removal clamps 110 on chain 111 lengthwise of the chains so that, first, a removal clamp 110 on one side of the longitudinal centerline of the apparatus picks up a laundry article, then a removal clamp 110*a* on the opposite side of this centerline picks up a laundry article, and then a removal clamp 110 picks up a laundry article, and so on. Also, the removal clamps release the laundry articles in the same alternating sequence.

The exit conveyor 112 can be driven in either direction so that the separated laundry articles can be removed from the apparatus on either side.

DRIVES FOR CONVEYORS AND ROLLER 145

A first electric motor 150 (FIGS. 1 and 3) drives the drive roller 78 for the lower conveyor belt 76 through a speed reduction drive of known design.

A second electric motor 151 (FIG. 1) drives the exit conveyor 112, roller 145 and chains 111 and 111*a*.

Through a gear reduction 152 (FIG. 4) motor 151 drives a pulley 153 engaging the lower end of an endless flexible belt 154, the upper end of which engages a pulley 155 affixed to a horizontal shaft 156. The inside corner sprocket 118 (FIG. 17) for chain 111 and the corresponding sprocket 118*a* for chain 111*a* are attached rigidly to shaft 156. Sprockets 118 and 118*a* are the drive sprockets for chains 111 and 111*a* , respectively. The other sprockets for chains 116,117 and 119 for chain 111 are idler sprockets, as are the correspondingly numbered sprockets for chain 111*a*.

Shaft 156 rotatably supports a second pulley which engages a flexible endless belt 157 (FIG. 1) extending up around the top of an idler pulley 158 and down from there across an idler pulley 159, and from idler pulley down around the bottom of a pulley 160 on the input shaft of a gear reduction 161 before passing up across pulley 155.

Roller 145 is driven from idler pulley 159 through an endless flexible belt 162 passing at one and around pulley 159 and at the opposite end around a pulley 163 on the end of roller 145.

The drive shaft 114 of exit conveyor 112 is connected by a shaft 164 to the output of gear reduction 161.

A third electric motor 165 is mounted at the inlet end of the apparatus (the right end in FIG. 1) and it drives the inlet conveyor 70 through a conventional gear reduction.

OPERATION

Recapitulating the operation of this apparatus, the entry clamp 22 picks up a pile of wet sheets or other laundry articles outside the front end of the apparatus and lifts the pile up into the apparatus. The entry conveyor 70 helps move these laundry articles into the apparatus where they drop onto the lower conveyor 75, which carries them horizontally from the entry end of the apparatus to the opposite end, where they pile up against the curved baffle plate 80. There the separator clamp 81 picks up one or more of the articles, usually several at a time, carries them part-way back toward the entry of the apparatus, and drops them onto the lower conveyor 75, which again carries them to the baffle plate 80. The seperator clamp moves up and down and back and forth substantially along the longtudinal centerline of the lower conveyor 75. This action of separator clamp tends to separate the laundry articles. The removal clamps 110 and 110*a* move up past the opposite side edges of baffle plate 80 and pick up single laundry articles near the edges of the pile. The removal clamps carry the laundry articles up and back toward the entry end of the apparatus and drop them onto the exit conveyor 112, which runs horizontally cross-wise above the lower conveyor 75. The lower parts of these laundry articles hanging down from the removal clamps engage a motor-driven roller 145, which deposits them on the exit conveyor.

I claim:

1. In an apparatus for separating laundry articles from a pile of such articles, the combination of:

a housing having an entry end;

an inlet conveyor at said entry end of the housing operable to carry laundry articles into the housing from outside said entry end;

an entry clamp having selectively operable means for grasping a pile of laundry articles and for releasing said laundry articles;

operating means for selectively lowering and raising said entry clamp and for moving said entry clamp between a position inside said housing adjacent said entry end and a position outside said housing at said entry end;

said operating means being operable:

(a) to move said entry clamp from a raised position inside said housing to a lowered position outside said housing for engaging a pile of laundry articles outside the housing at said entry end; and (b) after said selectively operable means in said entry clamp has caused said clamp to grasp laundry articles in the pile, to move said entry clamp to a raised position inside said housing adjacent said entry end;

said inlet conveyor being operable to carry into the housing the lower portions of said laundry articles hanging down from said entry clamp as said entry clamp moves from said lowered position outside said housing to said raised position inside said housing:

said selectively operable means in said entry clamp being operable to cause said raised entry clamp inside said housing to release said laundry articles;

a lower conveyor inside the housing for carrying the laundry articles, said conveyor having an entry end adjacent said entry end of the housing and an opposite exit end;

means providing a baffle at said exit end of said lower conveyor against which the laundry articles pile up;

a separator clamp above said lower conveyor having selectively operable means for grasping laundry articles and for releasing said articles;

means for lowering said separator clamp into close proximity to said baffle and for raising said separator clamp and moving it away from said baffle above said lower conveyor toward said entry end of the lower conveyor;

said selectively operable means in said separator clamp being operable to cause it to grasp laundry articles when lowered into close proximity to said baffle and to release said laundry articles and drop them onto said lower conveyor when raised and moved away from said baffle toward said entry end of the lower conveyor;

endless flexible chain means extending up past said baffle;

drive means for moving said chain means up past said baffle;

a plurality of removal clamps carried by said chain means at intervals along its length and movable in succession into engagement with the laundry articles piled against said baffle;

means for holding open each of said removal of clamps when it reaches the laundry articles piled against the baffle;

and means for closing each of said removal clamps as it moves up past the baffle to grasp one of said laundry articles piled against the baffle.

2. An apparatus according to claim 1 and further comprising:

an exit conveyor positioned above said lower conveyor away from said baffle;

said chain means being movable across and above said exit conveyor;

and means for opening each of said removal clamps to drop the laundry article grasped therein onto said exit conveyor when said removal clamp moves across and above said exit conveyor.

3. An apparatus according to claim 2 wherein said means for opening each of said removal clamps to drop the laundry article onto said exit conveyor comprises:

a release cam positioned above said exit conveyor;

and a roller attached to said removal clamp and engaging said release cam to open said removal clamp when said removal clamp moves across and above said exit conveyor.

4. An apparatus according to claim 3 and further comprising:

a motor-driven roller extending substantially horizontally above said exit conveyor at the side of the exit conveyor toward said baffle, said roller being positioned substantially below said chain means where said chain means moves across said exit conveyor, whereby to engage laundry articles hanging down from said removal clamps as they begin to pass across said exit conveyor and to deposit said articles on the exit conveyor.

5. An apparatus according to claim 4 wherein:

said means for closing each of said removal clamps is yieldable to permit said clamp to open and release the laundry article in its grasp when the downward force on said removal clamp exceeds a predetermined value.

6. An apparatus according to claim 5 wherein said means for closing each of said removal clamps is a spring in said clamp.

7. An apparatus according to claim 6 wherein said means for holding open each of said removal clamps when it reaches laundry articles piled against the baffle comprises:

an opening cam positioned near said baffle;

and said roller attached to said removal clamp, said roller engaging said opening cam to open said removal clamp when it reaches the laundry articles piled against the baffle.

8. An apparatus according to claim 1 wherein:

said endless flexible chain means comprises first and second chains extending up past said baffle near opposite side edges of the baffle;

and said removal clamps comprise a first set of clamps at intervals along said first chain and a second set of clamps at intervals along said second chain substantially midway between said first clamps on said first chain.

9. An apparatus according to claim 8 and further comprising:

means for opening each of said removal clamps after it has moved up away from said baffle to drop the laundry article grasped by said removal clamp.

10. An apparatus according to claim 9 and further comprising:

an exit conveyor positioned above said lower conveyor away from said baffle; and wherein:

said first and second chains move across and above said exit conveyor;

said means for holding open each of said removal clamps as it reaches the laundry articles piled against said baffle comprises first and second opening cams positioned respectively near said opposite side edges of the baffle and a respective roller attached to each clamp of said first and second sets of clamps and engageable with the corresponding opening cam to open its removal clamp when it reaches the laundry articles piled against the baffle;

and said means for opening each of said removal clamps after it has moved up away from said baffle comprises first and second release cams positioned above said exit conveyor, and said roller attached to each clamp of said first and second sets of clamps, each of said rollers engaging the corresponding release cam to open its removal clamp when said clamp moves across and above said exit conveyor.

11. An apparatus according to claim 10 and further comprising:

a motor-driven roller extending substantially horizontally above said exit conveyor at the side of the exit conveyor toward said baffle, said roller being positioned substantially below said first and second chains where they move across said exit conveyor, whereby to engage laundry articles hanging down from said first and second sets of clamps as they begin to pass across said exit conveyor and to deposit said articles on said exit conveyor.

12. An apparatus according to claim 11 wherein said means for lowering and raising said separator clamp comprises:

a substantially vertical air cylinder having a piston rod that moves up and down;

a substantially horizontal air cylinder having a piston rod that moves back and forth longitudinally of said lower conveyor;

and a chain carrying said separator clamp at one end and operatively coupled to said piston rod for the vertical air cylinder and to said piston rod for the horizontal air cylinder to lower and raise said separator clamp in response to the operation of said vertical and horizontal air cylinders.

13. An apparatus according to claim 1 wherein said means for lowering and raising said separator clamp comprises:

a substantially vertical air cylinder having a piston rod that moves up and down;

a substantially horizontal air cylinder having a piston rod that moves back and forth longitudinally of said lower conveyor;

and a chain carrying said separator clamp at one end and operatively coupled to said piston rod for the vertical air cylinder and to said piston rod for the horizontal air cylinder to lower and raise said separator clamp in response to the operation of said vertical and horizontal air cylinders.

14. In an apparatus for separating laundry aritcles from a pile of such articles, the combination of:

a housing having an entry end;

an inlet conveyor at said entry end of the housing operable to carry laundry articles into the housing from outside said entry end;

an entry clamp having selectively operable means for grasping a pile of laundry articles and for releasing said laundry articles;

operating means for selectively lowering and raising said entry clamp and for moving said entry clamp between a position inside said housing adjacent said entry end and a position outside said housing at said entry end;

said operating means being operable:

(a) to move said entry clamp from a raised position inside said housing to a lowered position outside said housing for engaging a pile of laundry articles outside the housing at said entry end; and (b) after said selectively operable means in said entry clamp has caused said clamp to grasp laundry articles in the pile, to move said entry clamp to a raised position inside said housing adjacent said entry end;

said inlet conveyor being operable to carry into the housing the lower portions of said laundry articles hanging down from said entry clamp as said entry clamp moves from said lowered position outside said housing to said raised position inside said housing;

and said selectively operable means in said entry clamp being operable to cause said raised entry clamp inside said housing to release said laundry articles.

15. An apparatus according to claim 14 and further comprising:

a lower conveyor inside said housing positioned to receive the laundry articles dropped from said raised entry clamp inside said housing.

16. In an apparatus for separating laundry articles from a pile of such articles, the combination of:

a housing having an entry end;

an inlet conveyor at said entry end of the housing having means thereon for carrying laundry articles up into the interior of the housing an entry clamp having opposed pivoted jaws and means for alternately moving said jaws pivotally apart and together;

a first chain suspending said entry clamp at one end for movement between a lowered position below and in front of said inlet conveyor and a raised position above and behind said inlet conveyor at said entry end of the housing;

a first air cylinder for operating said chain to raise and lower said entry clamp;

a carrier supporting said first cylinder;

a second chain connected to said carrier for moving said carrier and said first cylinder toward and away from said entry end of said housing;

a second air cylinder for operating said second chain to move said carrier and said first cylinder alternately (a) toward said entry end of the housing to a position in which said first chain holds said entry clamp outside the housing and in front of said inlet conveyor at said entry end and (b) away from said entry end to a position in which said first chain holds said entry clamp inside the housing and behind said inlet conveyor adjacent said entry end;

and spring means urging said carrier and said first cylinder toward said entry end of the housing to position said entry clamp outside the housing and in front of said inlet conveyor at said entry end;

said spring means, said second cylinder and said second chain being operable to move said carrier and said first cylinder to said position in which said entry clamp is outside said housing and in front of said inlet conveyor at said entry end;

said first cylinder and first chain being operable to lower said entry clamp with its jaws apart down in front of said inlet conveyor when said clamp is outside said housing at said entry end;

said means for moving said jaws of the entry clamp being operable to move said jaws together when said entry clamp is lowered into engagement with a pile of laundry articles outside said housing at said entry end;

said first cylinder and first chain being operable to raise said entry clamp with its jaws gripping laundry articles lifted from said pile;

said second cylinder and second chain being operable to move said carrier and said first cylinder to said position in which the raised entry clamp is behind said inlet conveyor and inside said housing adjacent said entry end; said inlet conveyor being operable to carry into the housing the depending portions of laundry articles lifted into the housing by said entry clamp;

and said means for moving said jaws of the entry clamp being operable to move said jaws apart to drop said laundry articles after said entry clamp has reached said raised position behind said inlet conveyor and inside the housing adjacent said entry end.

17. An apparatus according to claim 16 and further comprising:

a lower conveyor running along the interior of said housing from near said entry end to a location away from said entry end, said lower conveyor being positioned below said entry clamp when said entry clamp is inside said housing for receiving laundry articles dropped by said entry clamp.

18. In an apparatus for separating laundry articles from a pile of such articles, the combination of:

a lower conveyor for carrying a cluster of the laundry articles, said conveyor having an entry end and an opposite exit end;

means providing a baffle at said exit end of said conveyor against which the laundry articles pile up;

a separator clamp above said lower conveyor having selectively operable means for grasping laundry articles and for releasing said articles;

and means for lowering said separator clamp into close proximity to said baffle and for raising said separator clamp and moving it away from said baffle above said lower conveyor toward said entry end of the lower conveyor;

said selectively operable means in said separator clamp being operable to cause said separator clamp to grasp laundry articles lowered into close proximity to said baffle and to release said laundry articles to drop onto said lower conveyor when raised and moved away from said baffle toward said entry end of the lower conveyor.

19. An apparatus according to claim 18 wherein said means providing a baffle is a concave member that curves upwardly away from said lower conveyor in a direction away from said entry end of the lower conveyor.

20. An apparatus according to claim 18 wherein said means for lowering and raising said separator clamp comprises:

air cylinder means having reciprocable piston rod means;

and a chain carrying said separator clamp at one end and operatively coupled to said piston rod means to lower and raise said separator clamp in response to the operation of said air cylinder means.

21. An apparatus according to claim 20 wherein said air cylinder means comprises:

a substantially vertical air cylinder having a piston rod that moves up and down;

and a substantially horizontal air cylinder having a piston rod that moves back and forth longitudinally of said lower conveyor.

22. An apparatus according to claim 21 wherein said means providing a baffle is a concave member that curves upwardly from said exit end of said lower conveyor in a direction away from said entry end of the lower conveyor.

23. In an apparatus for separating laundry articles from a pile of such articles, the combination of:

a lower conveyor for carrying a cluster of laundry articles, said conveyor having an entry end and an opposite exit end;

means providing a baffle extending up from said conveyor at said exit end against which the laundry articles pile up;

endless flexible chain means extending up past said baffle;

drive means for moving said chain means up past said baffle;

a plurality of removal clamps carried by said chain means at intervals along its length and movable in succession into engagement with the laundry articles piled against said baffle;

means for holding open each of said removal clamps when it reaches the laundry articles piled against the baffle;

and means for closing each of said removal clamps as it moves up past the baffle to grasp one of said laundry articles piled against the baffle.

24. An apparatus according to claim 23 and further comprising:

means for opening each of said removal clamps after it has moved up away from said baffle to drop the laundry article grasped by said clamp.

25. An apparatus according to claim 24 wherein:

said means for closing each of said removal clamps is yieldable to permit said clamp to open and release the laundry article grasped by said clamp when the force tending to open said clamp exceeds a predetermined value.

26. An apparatus according to claim 25 wherein:

said means for closing each removal clamp is a spring in said clamp.

27. An apparatus according to claim 23 wherein said means for holding open each of said removal clamps comprises:

an opening cam positioned near said baffle;

and a respective roller attached to each removal clamp and engageable with said opening cam to open said clamp when it reaches the laundry articles piled against the baffle.

28. An apparatus according to claim 23 and further comprising:

an exit conveyor positioned above said lower conveyor away from said baffle;

said chain means being movable across and above said exit conveyor;

and means for opening each of said removal clamps to drop the laundry article grasped therein onto said exit conveyor when said clamp moves across and above said exit conveyor.

29. An apparatus according to claim 28 wherein said means for opening each of said removal clamps to drop the laundry article onto said exit conveyor comprises:

a release cam positioned above said exit conveyor;

and a roller attached to said removal clamp and engaging said release cam to open said clamp when said clamp moves across and above said exit conveyor.

30. An apparatus according to claim 29 and further comprising:

a motor-driven roller extending substantially horizontally above said exit conveyor at the side of the exit conveyor toward said baffle, said roller being positioned substantially below said chain means where said chain means moves across said exit conveyor, whereby to engage laundry articles hanging down from said removal clamps as they begin to pass across said exit conveyor and to deposit said articles on the exit conveyor.

31. An apparatus according to claim 30 wherein:

said means for closing each of said removal clamps is yieldable to permit said clamp to open and release the laundry article in its grasp when the downward force on said clamp exceeds a predetermined value.

32. An appartus according to claim 31 wherein said means for closing each removal clamp is a spring in said clamp.

33. An apparatus according to claim 32 wherein said means for holding open each of said removal clamps when it reaches laundry articles piled against the baffle comprises:

an opening cam positioned near said baffle;

and said roller attached to said removal clamp, said roller engaging said opening cam to open said clamp when it reaches the laundry articles piled against the baffle.

34. An apparatus according to claim 23 wherein:

said endless flexible chain means comprises first and second chains extending up past said baffle near opposite side edges of the baffle;

and said removal clamps comprise a first set of clamps at intervals along said first chain and a second set of clamps at intervals along said second chain substantially midway between said first clamps on said first chain.

35. An apparatus according to claim 34 wherein said means for closing each of said removal clamps is a spring in the clamp.

36. An apparatus according to claim 35 and further comprising:

means for opening each of said removal clamps after it has moved up away from said baffle to drop the laundry article grasped by said clamp.

37. An apparatus according to claim 36 and further comprising:

an exit conveyor positioned above said lower conveyor away from said baffle; and wherein:

said first and second chains move across and above said exit conveyor;

said means for holding open each of said removal clamps as it reaches the laundry articles piled against said baffle comprises first and second opening cams positioned respectively near said opposite side edges of the baffle and a respective roller attached to each clamp of said first and second sets of clamps and engageable with the corresponding opening cam to open its removal clamp when it reaches the laundry articles piled against the baffle;

and said means for opening each of said removal clamps after it has moved up away from said baffle comprises first and second release cams positioned above said exit conveyor, and said roller attached to each clamp of said first and second sets of clamps, each of said rollers engaging the corresponding release cam to open its removal clamp when said clamp moves across and above said exit conveyor.

38. An apparatus according to claim 37 further comprising:

a motor-driven roller extending substantially horizontally above said exit conveyor at the side of the exit conveyor toward said baffle, said roller being positioned substantially below said first and second chains where they move across said exit conveyor, whereby to engage laundry articles hanging down from said first and second sets of removal clamps as they begin to pass across said exit conveyor and to deposit said articles on said exit conveyor.

* * * * *